United States Patent [19]

Nishikawa

[11] 4,381,576

[45] May 3, 1983

[54] APPLIANCE FOR REMOVING THE CONTENTS OF BOTTLES

[76] Inventor: Richard Nishikawa, 1560 N. Hobart Blvd., Los Angeles, Calif. 90027

[21] Appl. No.: 261,795

[22] Filed: May 8, 1981

[51] Int. Cl.[3] ..... A47L 17/06

[52] U.S. Cl. ..... 15/236 R; 15/105

[58] Field of Search ..... 15/236 K, 111, 118, 15/105

[56] References Cited

U.S. PATENT DOCUMENTS

| | | | |
|---|---|---|---|
| 2,140,209 | 12/1938 | Rietveld | 15/236 R |
| 2,294,096 | 8/1942 | Rice | 15/236 R X |
| 2,494,572 | 1/1950 | Miller | 15/236 R X |
| 2,634,497 | 4/1953 | Waldesbuehl | 15/236 R X |
| 2,828,502 | 4/1958 | Tupper | 15/236 R X |

*Primary Examiner*—Chris K. Moore

*Attorney, Agent, or Firm*—Herzig & Walsh, Inc.

[57] ABSTRACT

An appliance or utensil for removing remaining relatively viscous materials in bottles or containers having a relatively restricted neck. The appliance embodies a handle which is insertable through the neck of the bottle and an operative element in the form of a channel member having flexible side walls so that it can be rotated against the interior surface of the bottle with a side wall of the channel rubbing against the surface so as to pick up or gather in the channel the remaining viscous material in the bottle. The channel member is then removed through the neck of the bottle carrying the gathered material with it. The material is then removed from the channel by means of a pusher moved along the length of the channel member.

5 Claims, 6 Drawing Figures

APPLIANCE FOR REMOVING THE CONTENTS OF BOTTLES

BACKGROUND OF THE INVENTION

1. Field of the Invention

The field of the invention is that of appliances or utensils particularly adopted for removing materials or contents from bottles or similar containers, particularly containers having a restricted neck and which contain or have contained relatively viscous materials not fluid enough to readily drain out.

2. Background of the Invention

Background patents include the following U.S. Pat. Nos. 1,235,038; 2,539,225; 2,634,497; 2,649,604; and 2,828,502.

Problem with which the invention deals may be illustrated with respect to bottles such as, particularly, catsup bottles. Such bottles typically have relatively restricted necks. Ordinarily such bottles are placed on the customer's table and the customer dispenses catsup directly from the bottle. The material, that is catsup, is relatively thick and viscous and when most of the contents of the bottle have been dispensed it is difficult or impossible to remove the remaining part of the contents which often become wasted. Attempts have been made to resolve the problem by placing the bottles upside down in a rack over a pan with the objective to have the remaining contents in the bottles drained downward and outward through the necks. This is a slow, cumbersome, and relatively ineffective manner of attempting to resolve the problem. Manipulation of the bottles is required and time is wasted and space is occupied by the rack used to hold the bottles and pans while this is attempted.

As explained herein after the herein invention seeks to overcome and resolve the foresaid problems and defficiencies of the prior art.

SUMMARY OF THE INVENTION

In a preferred form of the invention as described in detail hereinafter it is provided with a handle carrying a removement element or tool which can be readily inserted into the neck of the bottle and then manipulated to pick up and withdraw any remaining contents in the bottle or container. The appliance has a handle of size that can readily fit through the neck of the bottle. The operative element or tool is carried at the end of the handle. In a preferred form it is generally a U-shaped channel member and perfer of desired length, the cross section providing flexible parallel walls.

The said element can be placed with the one of the flexible walls against the inside cylindrical surface of the bottle and the element can be rotated inside of the bottle by the handle so that one side of the U-shaped channel rubs along the interior surface of the bottle so that the relatively viscous contents are picked up or gathered in the U-shaped channel element and held there while the implement is withdrawn from the neck of the bottle. An additional small tool is then provided which is simply a pusher member having a part configurated to fit into the U-shaped channel so that it can be inserted into the channel and pushed along to push the extracted contents out and into another container of suitable type. The operation of insertion and rotation of the flexible element within the bottle can be repeated as necessary so that the remaining contents can be all removed.

In the light of the foregoing the primary object of the invention is to realize and make available an improved implement or tool capable of utilization to remove contents of a type which are relatively viscous from a bottle or the like having a relatively restricted neck in circumstances wherein all of the contents cannot readily be removed simply by attempting to cause them to drain out through the neck.

A further object is to realize an implement or appliance as in the foregoing having a handle of size which can be inserted through the neck of the bottle and an active element in the form of member which may be a channel member having at least one flexible wall, so that the element can be rotated within the bottle or container with the wall pressed against the inside circumferential surface of the bottle to gather the contents into the collecting member.

A further object is to provide a pusher member configurated to be adopted to remove or push the gathered contents out of the collecting element after removing from the bottle.

Further objects and additional advantages will become apparent from the following detailed description and annexed drawings.

DESCRIPTION OF THE PREFERRED EMBODIMENT AND BEST MODE OF PRACTICE OF THE INVENTION

Figure 1:
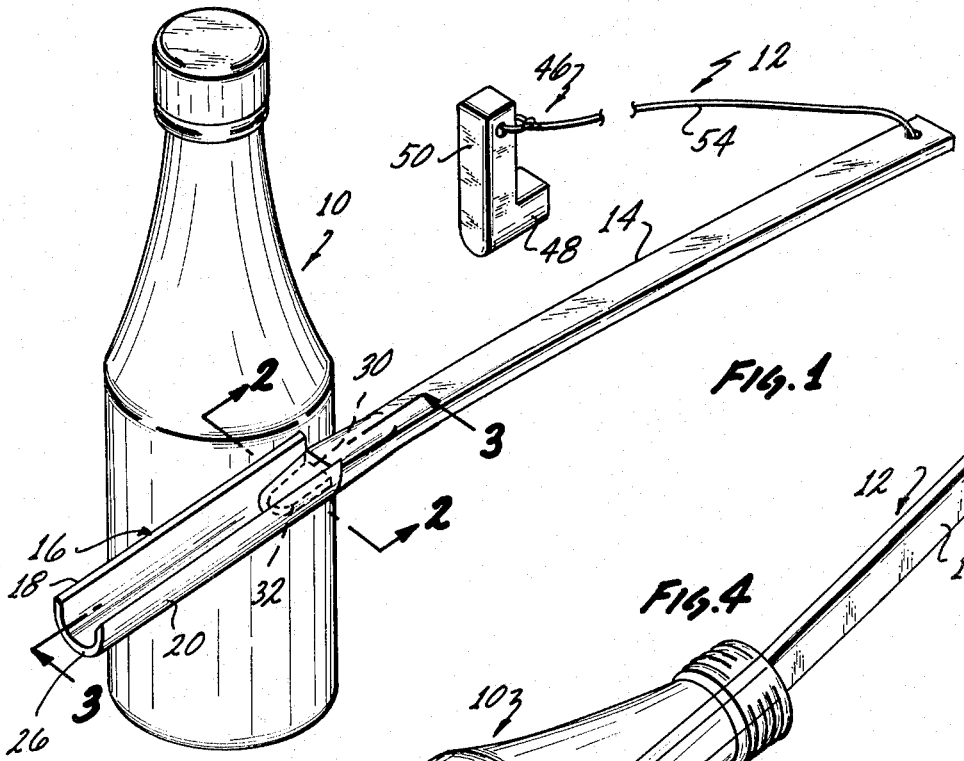
FIG. 1 is an isometric view of a preferred form of the invention along with the outline of a bottle.

Referring to FIG. 1 of the drawings Numeral 10 is in illustration of a typical type of bottle such as a catsup bottle with a restricted neck. A preferred form of the tool is designated by Numeral 12. It includes a handle 14 and an operative gathering element or tool 16; the handle 14 may be made of any suitable material such as wood or plastic and may have some degree of flexibility.

Figure 3:
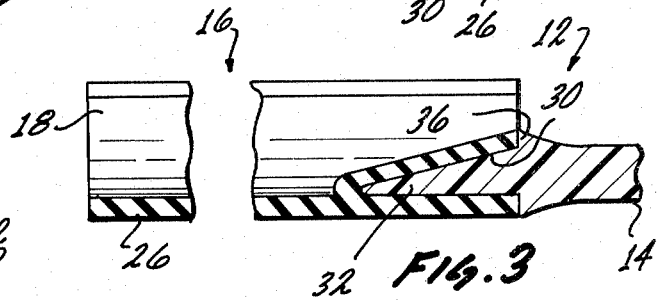
FIG. 3 is a partial cross-sectional view taken along the line 3—3 of FIG. 1.

The gathering element 16 in the preferred form is constructed of rubber or comparable flexible material. It is U-shaped in cross-section as shown so as to have side walls 18 and 20 forming a channel between them. The gathering element 16 may be fabricated by any suitable process. Its bottom part is designated at 26 and at one end there is formed in it a tapered opening or receptacle 30. The end part of the handle 12 is formed to have tapered portion 32 as may be seen in FIG. 3. This portion extends from square shoulder 36 formed on the handle 12 the portion 32 is inserted into the cavity 30 and can be held therein simply by friction or can be glued therein.

Figure 6:
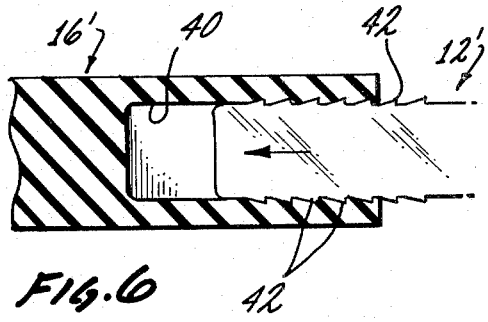
FIG. 6 is a partial cross-sectional view illustrating a modified form of attachment or securement of the handle to the gathering element.

The handle can be secured to the element 16 in other ways. One alternative way of attachment or securement is shown in FIG. 6. In this figure Numeral 16' designates the end part of the modified form of the gathering element. It has in it rectilinear cavity designated at 40. Numeral 12' designates in part a modified form of handle which has a shape to be received in cavity 40. The end part 12' has formed on its sides, barbs or barb elements 42 so that when this part is inserted into the cavity 40 it is held therein by the barbs.

Figure 4:
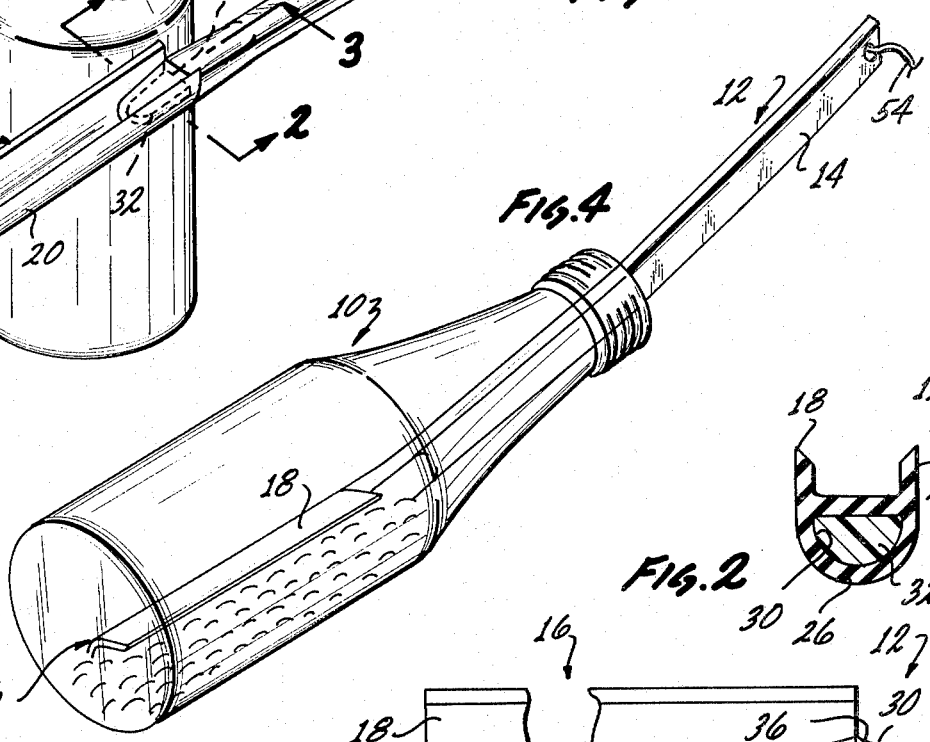
FIG. 4 is an isometric view illustrating utilization of the implement in the bottle.
Figure 2:
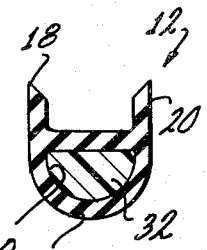
FIG. 2 is a cross-sectional view taken along the line 2—2 of FIG. 1.

FIG. 4 illustrates the manner of utilization of the utensil or appliance. The tool is inserted through the restricted neck of the bottle as shown and is manipulated so that one of the flexible sides 18 or 20 of the element 16 is pressed against the inside cylindrical surface of the bottle. The element 16 can be rotated by the handle 14 circularily inside the bottle with the flexible side of the element such as the side 20 pressed against the inside surface of the bottle so that remaining contents of relatively viscous material in the bottle are picked up by the element 16 and contained therein. The tool then can be withdrawn from the bottle by the handle 14 with the material that has been picked up contained in channel in the element 16.

Figure 5:
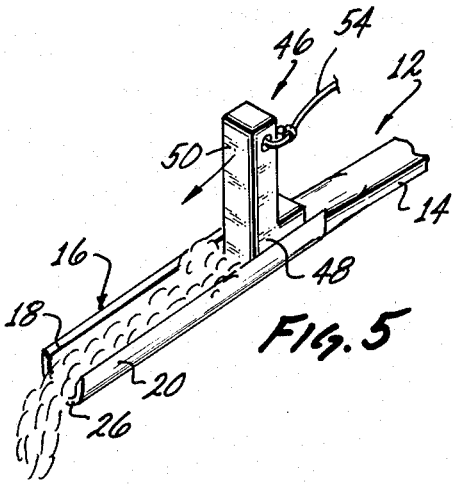
FIG. 5 is an isometric view illustrating the removal of the collected material from the collecting implement after removal from the bottle.

The utensil or appliance includes an additional operative member or tool 46 as may be seen in FIGS. 1 and 5. This member has a lower part 48 to fit into the channel in the element 16, the lower portion of the part 48 being rounded or configurated to fit the channel in the element 16 between the side walls 18 and 20. The member 46 has right angle portion 50 forming a handle by which it can be grasped and preferably it is attached to the end of the handle 14 by a cord 54.

FIG. 5 illustrates the manner of utilization of the part 46. Its lower portion 48 is simply inserted into the channel in the element 16 and then pushed along the inside of the element so that the gathered contents are pushed out one end of the channel so that they can be allowed to fall into another container which preferably would be one with a relatively large open top.

From the foregoing, those skilled in the art will readily understand the nature and construction of the invention and the manner of utilization, and the manner in which the objects as set forth in the foregoing are realized.

The foregoing disclosure is representative of a preferred form of the invention and is to be interpreted in an illustrative rather than a limiting sense, the invention to be accorded the full scope of the claims appended hereto. It is intended that the claims should cover alternatives and modifications that might be made by those skilled in the art including a range of equipments. Illustratively some variations might be made in the exact configurations of the channel member such as some variations in the exact configurations of the channel itself and the actual extent and flexibility of its side members.

What is claimed is:

1. As an article of manufacture: an applicance having a handle member adapted for removing relatively viscous material remaining in a bottle or container having an enlarged body and a relatively restricted neck part, the body having several times the diameter of the neck part, an active element in the form of a channel member affixed to the end of the handle member, the active element being formed of relatively flexible material and configurated to form a channel having spaced side members and at least one side member adapted to be placed against the inside surface of the bottle and rotated so that the material in the bottle is gathered in the channel member, the channel member being of a size which is substantially that of the restricted neck so that it can be inserted into and withdrawn through the restricted neck of the bottle without displacement of the said spaced side members from their normal configuration, the appliance including a handle having sufficient flexibility that one full side surface of one of said side members can be pressed against the inside surface of the bottle.

2. An article as in claim 1 wherein the channel member is formed of rubber, the channel member and the handle having mutually engageable portions adapted for securing one to the other.

3. An article as in claim 2 wherein the channel member is of molded construction having a cavity at one end, the handle member having a portion formed at one end configurated to fit into the cavity in the channel member and to be held therein.

4. An article as in claim 2 wherein the active element is of U-shaped construction having parallel and flexible side walls the cross-sectional shape being semi-circular.

5. An article as in claim 1 including a member having a part configurated to fit into the active element and to be moved along the element to push the contents held therein out of one end thereof.

* * * * *